United States Patent [19]

Khoury

[11] 4,184,606

[45] Jan. 22, 1980

[54] CHILD RESISTANT PULL TAB

[75] Inventor: Nick S. Khoury, Worth, Ill.

[73] Assignee: The Continental Group, Inc., New York, N.Y.

[21] Appl. No.: 954,007

[22] Filed: Oct. 23, 1978

[51] Int. Cl.[2] ..... B65D 41/32

[52] U.S. Cl. ..... 220/270

[58] Field of Search ..... 220/266–274

[56] References Cited

U.S. PATENT DOCUMENTS

| | | | |
|---|---|---|---|
| 3,813,000 | 5/1974 | Underwood | 220/269 |
| 4,084,722 | 4/1978 | Rosynek et al. | 220/270 |

*Primary Examiner*—George T. Hall

*Attorney, Agent, or Firm*—Charles E. Brown

[57] ABSTRACT

A pull tab of the type having a mounting ear which is rigidly secured to a container panel and wherein a major portion of the tab is hingedly connected to the mounting ear for pivoting to an operative position. The mounting ear is defined by a generally C-shaped lance or cut line and the tab is distinguished by having a child proof feature in the form of one or more interruptions of the lance or cut line with the interruption being selectively a full thickness portion of the tab body or a portion of the tab body having a score formed therein whereby the force necessary to effect a separation of the tab body from the mounting ear so that the tab body may hinge relative to the mounting ear may be selectively varied so as to control the force required to place the tab in a use condition, and thus permit the use of the tab to be restricted to persons other than children of a generally selected age.

6 Claims, 4 Drawing Figures

CHILD RESISTANT PULL TAB

This invention relates in general to new and useful improvements in pull tabs for easy opening containers, and more particularly to a pull tab which has incorporated therein a child resistant feature.

Particular reference is made to my prior U.S. Pat. No. 3,322,296, granted May 30, 1967, wherein there is disclosed a pull tab having formed in the body thereof generally surrounding the customary rivet hole a mounting ear. This mounting ear is defined by a generally C-shaped lance or cut line with the mounting ear being connected to the tab body only by a transverse hinge line extending between the ends of the lance or cut line. Except for the slight resistance to the bending of the metal of the tab body to effect hinging along the hinge line, there is no resistance to the hinging of the tab relative to the mounting ear except for the force applied to effect opening of the container.

It has been found with my previous tab that the initial lifting force is such that small children can effect opening a container utilizing my prior tab construction. This invention particularly relates to a modification of my prior pull tab so that it is child resistant or child proof. Most specifically, I have modified my prior tab so that the lance or cut line which defines the mounting ear is interrupted to require a predetermined lifting force on the tab body lifting end to effect separation of the tab body from the mounting ear to permit hinging of the tab body relative to the mounting ear.

I have found that by varying the effective cross section of the unlanced or uncut metal, I can vary the force required to effect the initial lifting of the lifting end of the tab body and thereby control the force required to permit the tab to function.

In accordance with my invention, the lance or cut line is interrrupted and the interrupted area may be of full tab body thickness or may be scored. The sole function of the interruption of the cut line or lance is to require a conrolled lifting force to effect hinging of the tab body relative to the mounting ear and, where desired, there may be a plurality of interruptions to the lance or cut line.

I have knowledge of a tab which has been developed in Germany which employs a mounting ear hingedly connected to the tab body in the same general manner as that of my aforementioned U.S. Pat. No. 3,322,296, but wherein the mounting ear is defined in an entirely different manner. Most specifically, the mounting ear of the German pull tab is defined by the removal of a transversely extending portion of the tab body adjacent to and on the side of the rivet hole remote from the end of the tab which applies pressure on the container panel, and by a pair of longitudinally extending score lines disposed on opposite sides of the rivet hole and extending toward the pressure applying end from opposite ends of the cutout. I have tested the German pull tab and have observed the construction thereof, and it is my belief that the construction thereof has no intended function whatsoever to provide for an increase in lifting force necessary to actuate the pull tab.

With the above and other objects in view that will hereinafter appear, the nature of the invention will be more clearly understood by reference to the following description, the appended claims, and the several views illustrated in the accompanying drawings.

IN THE DRAWINGS

Figure 1:
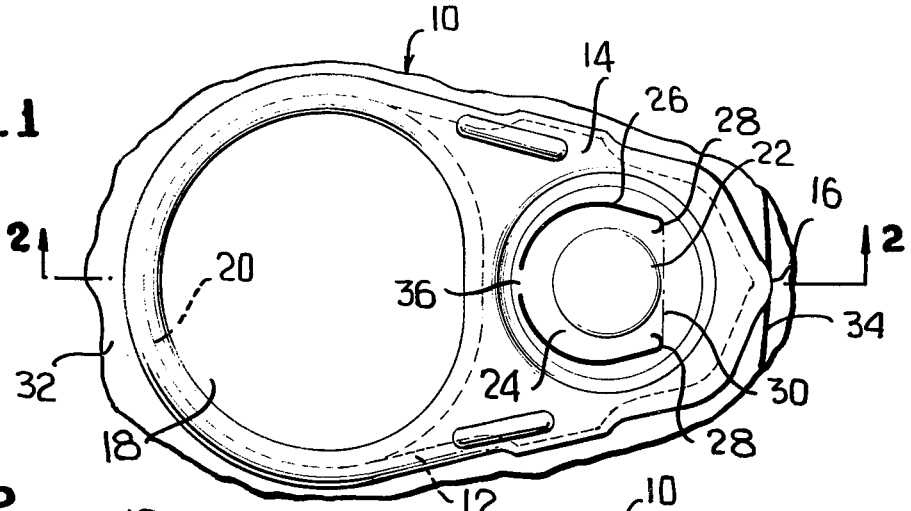
FIG. 1 is a plan view of a pull tab formed in accordance with my invention, showing one form of child proofing.

Referring now to the drawings in detail, it will be seen that there is illustrated in FIG. 1 a pull tab formed in accordance with this invention, the pull tab being generally identified by the numeral 10. The pull tab is formed of sheet metal which is preferably folded to define a peripheral reinforcing hem 12. The pull tab 10 includes a body 14 which is specifically shaped to define at one end a pressure or force applying nose 16 while the opposite end is a lifting end and is shaped to define a finger receiving ring 18. The tab body 14 is provided with an internal hem 20 around the internal periphery of the ring 18.

Figure 2:
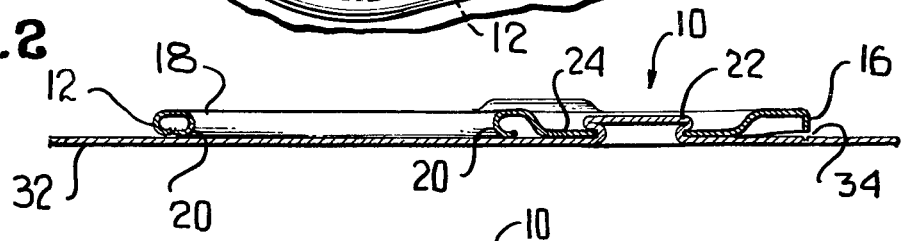
FIG. 2 is a longitudinal vertical sectional view taken generally along the line 2—2 of FIG. 1, and shows the pull tab attached by way of a rivet to a container panel.

Between the ring 18 and the nose 16 the tab body 14 is provided with a rivet hole 22. The rivet hole 22 is formed in a mounting ear 24 which is defined by a lance or cut line 26. In accordance with the teaching of my prior U.S. Pat. No. 3,322,296, the lance or cut line 26 would normally be generally C-shaped in plan outline and would terminate either in reversely turned forward portions 28, as illustrated, or in small diameter apertures (not shown). A hinge line 30 is defined between the forward ends of the lance or cut line 26 with it being understood that when the ring end of the tab is lifted, the tab body would hinge or bend relative to the mounting ear 24 along the hinge line 30 so that the nose 16 may depress against a container panel and effect rupture thereof along a score line formed therein. Most specifically, as illustrated in FIG. 2, the pull tab 10 is mounted on a container panel 32 by means of an integral rivet 34 with the mounting ear 24 clamped tightly against the upper surface of the container panel 32. The nose 16 of the pull tab is aligned with a score 34 formed in the container panel 32 and defining a removable panel in a customary manner.

In accordance with this invention, instead of the lance or cut line 26 being continuous, it is interrupted and therefore the tab body 14 is not free to hinge about the hinge line 30 relative to the mounting ear 24 in the usual manner. As a result of the interruption of the lance or cut line 26, there remains a portion 36 of the tab body between the adjacent portions of the lance or cut line 26. In the embodiment illustrated in FIG. 1, the tab body portion 36 is of a full thickness and is of a controlled length so as to control the amount of upwardly directed force on the lifting end of the tab 10 required to rupture the tab body between the adjacent ends of the lance or cut line 26.

It is to be understood that it is necessary for the tab body portion 36 to be ruptured before the tab body can hinge relative to the mounting ear 24 and apply a rupturing force on the container panel. Accordingly, the rupturing of the tab body portion 36 is separate and apart from the rupturing of the end panel 32 along the score line 34. Thus, the intermediate tab body portion 36 provides for a controlling of the force requires to render the pull tab 10 operative, and by so selecting that force the tab 10 can be made child proof. In other words, the person utilizing the tab 10 must have sufficient strength to effect rupture of the tab body portion 36 in order to utilize the tab in the opening of an associated container.

It is to be noted that the intermediate tab body portion 36 is disposed generally centrally of the lance or cut line 24 and remote from the hinge line 30.

Figure 3:
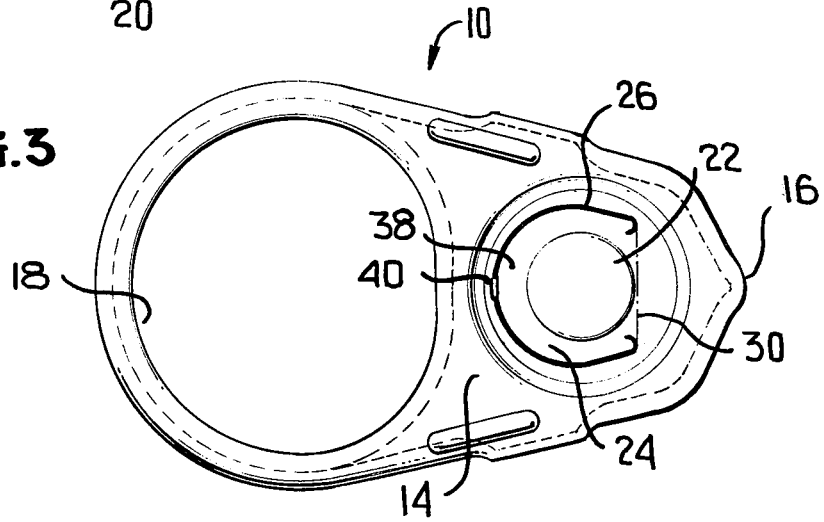
FIG. 3 is a plan view similar to FIG. 1, and shows a modified form of child proofing.

In FIG. 3 there is illustrated a modified form of the child proof feature. Instead of the tab body 14 having between the adjacent ends of the lance or cut line 26 an uninterrupted portion of the tab body, there is provided a portion 38 of the tab body which has formed therein a score 40. It will be seen that the formation of a score in the portion of the tab body between the adjacent ends of the lance or cut line 26 will provide for a more accurate control over the force required to effect the utilization of the pull tab.

It is to be noted that the scored portion 40 is in substantially the same position as the tab body portion 36.

Figure 4:
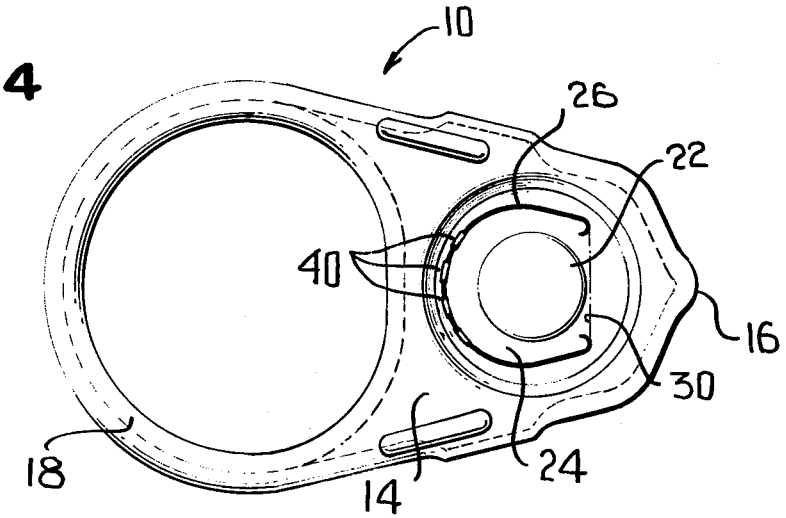
FIG. 4 is a plan view of a pull tab similar to FIG. 1, and shows still another form of my invention.

With particular reference to FIG. 4, it will be seen that the pull tab illustrated is of a slightly different construction. Instead of the lance or cut line 26 being interrupted only in its central portion, there are a plurality of interrupted areas 40. The interrupted areas 40 are provided with scores so as to control the force necessary to effect rupture of the tab body in the interrupted areas 40. It is to be noted that the interrupted areas 40 are disposed remote from the hinge line 30 and are generally centered with respect to the lance or cut line 26.

It will be apparent that the provision of a plurality of interrupted areas 40 provides for more accurate control over the lifting force required to make the pull tab of FIG. 4 operable.

It will be readily apparent to one skilled in the art that the force required to separate the mounting ear from the tab body may be very accurately controlled and thus the pull tab, modified in accordance with this invention, can be reliably utilized to restrict the use thereof to children of a predetermined strength and thereby to children of a preselected age.

It is to be understood that once rupture of the tab body has been effected and the two or more separate parts of the lance or cut line have been interconnected, the pull tab body may be hinged relative to the mounting ear in the same manner as disclosed in my U.S. Pat. No. 3,322,296 and the pull tab may be utilized in the opening of a previously scored container panel.

Although several embodiments of the invention have been specifically illustrated and described herein, it is to be understood that minor variations may be made in the tab structure without departing from the spirit and scope of the invention as defined by the appended claims.

I claim:

1. In a pull tab for easy opening containers wherein said tab includes a tab body having means at one end for applying an inwardly directed rupturing pressure on a container panel when the opposite end of said tab body is moved outwardly, and said tab body has a mounting ear formed from the central portion thereof by a generally C-shaped cut line and being connected to said tab body along a hinge line, the improvement comprising said pull tab having a child proof feature in the form of a selected portion of said cut line being interrupted to require a predetermined lifting force on said tab body other end to effect separation of said tab body from said mounting ear to permit hinging of said tab body relative to said mounting ear.

2. The pull tab of claim 1 wherein said cut line interruption is generally remote from said hinge line.

3. The pull tab of claim 1 wherein said cut line when complete would have central portion, and said cut line interruption is in said central portion.

4. The invention according to claim 1 wherein said tab is formed from sheet metal and said tab having a depressed body portion and said cut line is located in said depressed portion.

5. The pull tab of claim 1 wherein said cut line interruption is in the form of a scored portion.

6. The pull tab of claim 1 wherein said cut line interruption is in the form of a plurality of spaced scored portions.

* * * * *